US008540420B2

(12) United States Patent
Morata et al.

(10) Patent No.: US 8,540,420 B2
(45) Date of Patent: Sep. 24, 2013

(54) GONG MOUNTING DEVICE FOR STRIKING WATCH

(75) Inventors: Philippe Morata, Cormondreche (CH); Gérald Roden, Geneva (CH)

(73) Assignee: Bulgari Horlogerie S.A., Neuchatel (CH)

( * ) Notice: Subject to any disclaimer, the term of this patent is extended or adjusted under 35 U.S.C. 154(b) by 698 days.

(21) Appl. No.: 12/722,907

(22) Filed: Mar. 12, 2010

(65) Prior Publication Data

US 2010/0232262 A1 Sep. 16, 2010

(30) Foreign Application Priority Data

Mar. 13, 2009 (EP) ..... 09405048

(51) Int. Cl.
*G04B 37/00* (2006.01)

(52) U.S. Cl.
USPC ..... 368/315

(58) Field of Classification Search
USPC ..... 368/315
See application file for complete search history.

(56) References Cited

U.S. PATENT DOCUMENTS

| | | | | |
|---|---|---|---|---|
| 2,014,754 | A * | 9/1935 | Wheeler | 368/41 |
| 2,090,370 | A * | 8/1937 | Lux | 368/300 |
| 3,869,855 | A * | 3/1975 | Sodler | 368/243 |
| 4,059,957 | A * | 11/1977 | Monnet | 368/292 |
| 4,258,432 | A * | 3/1981 | Zafferri et al. | 368/250 |
| 4,271,498 | A * | 6/1981 | Zafferri et al. | 368/250 |
| 4,433,921 | A * | 2/1984 | Gogniat et al. | 368/294 |
| 4,979,156 | A * | 12/1990 | Kester | 368/289 |
| 5,896,349 | A * | 4/1999 | Haze | 368/228 |
| 7,182,508 | B2 * | 2/2007 | Bertrand et al. | 368/295 |
| 7,217,030 | B2 * | 5/2007 | Papi | 368/150 |
| 2008/0165630 | A1 | 7/2008 | Candaux | |
| 2009/0147630 | A1 * | 6/2009 | Clerc et al. | 368/290 |

FOREIGN PATENT DOCUMENTS

| | | |
|---|---|---|
| CH | 28544 | 5/1904 |
| WO | 2006/095244 A2 | 9/2006 |

OTHER PUBLICATIONS

European Search Report, mailing date of Sep. 8, 2009, issued in corresponding European Patent Application No. EP 09405048.

* cited by examiner

*Primary Examiner* — Renee Luebke
*Assistant Examiner* — Jason Collins
(74) *Attorney, Agent, or Firm* — Westerman, Hattori, Daniels & Adrian, LLP

(57) ABSTRACT

Gong mounting device designed to bear against a crystal (10) closing a striking-watch case. This device comprises a block (20) for immobilizing at least one end (1, 2) of a gong ($T_1$, $T_2$) inside the watch case, and a means (30) for mounting this block (20) on said crystal (10). The mounting means (30) is a clamping-type mounting means enabling the block (20) to exert pressure on the crystal (10).

21 Claims, 3 Drawing Sheets

GONG MOUNTING DEVICE FOR STRIKING WATCH

The present invention relates to a device for mounting gongs in a striking watch, especially a device designed to be located against the crystal closing the case of such a timepiece.

Striking watches are fitted with a sound-generating member capable of producing one or more sound waves of different tones designed to propagate outside of the watch case. Typically, the member vibrating inside the case may be a gong which generates such waves after being struck by the hammer of the striking work.

The gong of a wristwatch usually consists of a circular-section metal bar or a metal strip wound around the watch movement. The length of the wound part determines the desired tone.

Mounted firmly at one of its ends, which is where the hammer strikes, the gong is thus supported by a block which is generally fixed to the movement or to the watch middle.

If watches are to have an effective sound function, they must be made capable of producing clearly audible sounds. While this feature usually creates few problems in so-called pocket watches or watches of the larger sizes, the same cannot be said of much smaller watches such as wristwatches, for which the subject of the present invention is primarily intended.

The limited amount of space available inside the cases of these watches directly limits the size of the multiple components which make up its movement. This miniaturization affects the amount of energy that such a watch can produce and in the last analysis is prejudicial to the acoustic capabilities of the sound-generating members. The case of such a watch is itself the first element that prevents the propagation of sound waves to the exterior. This disadvantage is accentuated by the presence of seals which are fitted to the great majority of wristwatch cases, especially at the interface between the crystal and the bezel, and between the middle and the back of the case. The latter may also be closed by a back crystal to allow the movement to be seen from the outside.

To improve sound propagation through the case, it is prior art to mount the block to which the gongs are attached on the movement and add a bearing against the crystal, either on the back or on the dial side.

In accordance with other mounting systems, it is suggested that the block be mounted on this crystal, by adhesive bonding or by welding.

Whether the crystal is mounted on the dial side or the back, it is invariably designed to close the case, which must usually be protected against the ingress of dust and water in order to properly protect the movement and the gongs.

The object of the present invention is to improve the transmission of the sound waves which is a significant component both of the strength of the sound perceived on the outside of the case and of the acoustic quality of the waves transmitted by the latter.

To this end, the subject of the present invention is a gong support mounting device in accordance with claim 1.

For this purpose, a gong mounting device is suggested that is designed to bear against the crystal closing the watch case. The present device comprises a support or block capable of immobilizing at least one end of a gong inside the case, together with a means for mounting this block against the crystal. According to the invention, this mounting means is a clamping-type mounting means enabling the block to create pressure against the crystal. Being permanently set up by a clamping force applied to these two parts, this pressure has the advantage of accentuating the transfer of the strength and quality of the sound waves transmitted through the case.

In accordance with the preferred embodiment, the clamping-type mounting means incorporates a means of adjustment for modifying the force of assembly applied between the block and the crystal.

Advantageously, the clamping effect generated by this means is reversible. This makes it equally easy both to assemble and to separate the block and crystal once placed together.

Contrary to a received idea whereby the closing crystal or crystals of a watch case should not be pierced, the invention preferably suggests that the clamping-type mounting means should pass through the crystal via at least one hole made in the thickness of the crystal.

The clamping-type mounting means thus comprises preferably at least one threaded member that has, at one of its ends, a collar or bearing surface in contact with the outer face of the crystal. This member is designed to be screwed to a threaded portion located in the block to which the ends of the gongs are to be attached.

Advantageously, the arrangement of such a means makes it possible to create, in a range varying from the clamping limit to mechanical failure of the parts in question, a pressure of variable intensity between the block and the crystal.

The watch case can nonetheless still be made resistant to liquids and fine dust particles by the addition of at least one seal at the interface between the crystal and the bearing surface associated with the threaded member passing through the crystal.

Other advantages and features will become apparent on reading the following description referring to a preferred embodiment of the subject of the invention, and certain variants, which are given without implying any limitation and illustrated schematically and by way of example in the accompanying figures, in which:

FIG. 1 is a perspective view of the inside face of the crystal against which the mounting device, which holds the gongs of a striking wristwatch firmly in place, is positioned;

FIGS. 1*a* and 1*b* are detail views of the mounting device seen in FIG. 1, showing the inner and outer faces, respectively, of the crystal;

Figure 3:
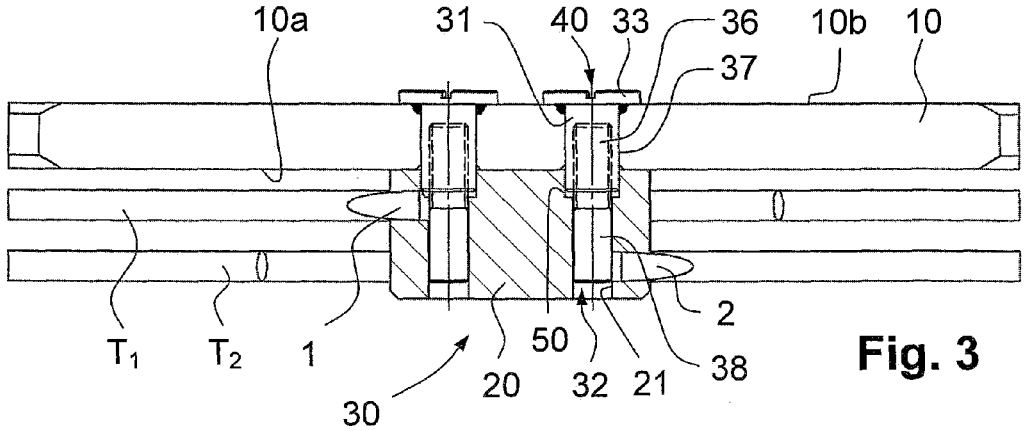
FIG. 3 is a view similar to FIG. 2, illustrating a variant of the mounting device of the present invention.
Figure 3A:
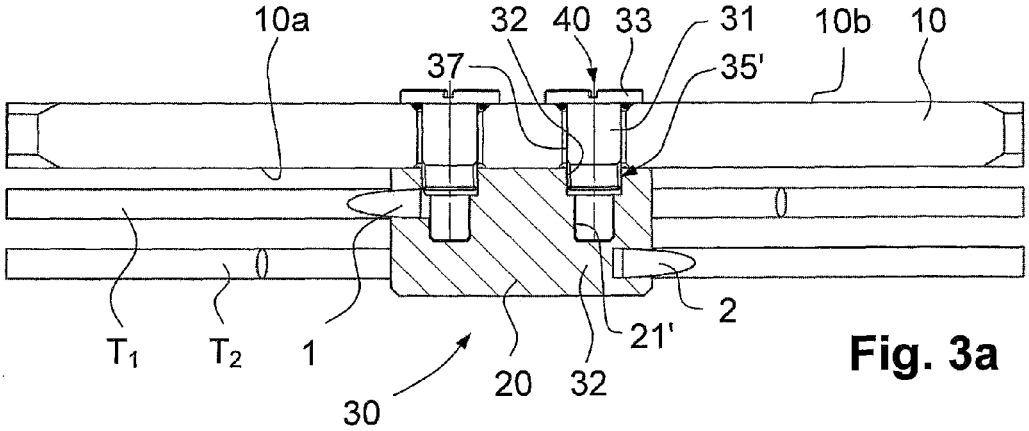

FIG. 3*a* shows a variant of the device depicted in FIG. 3; and

Figure 1:
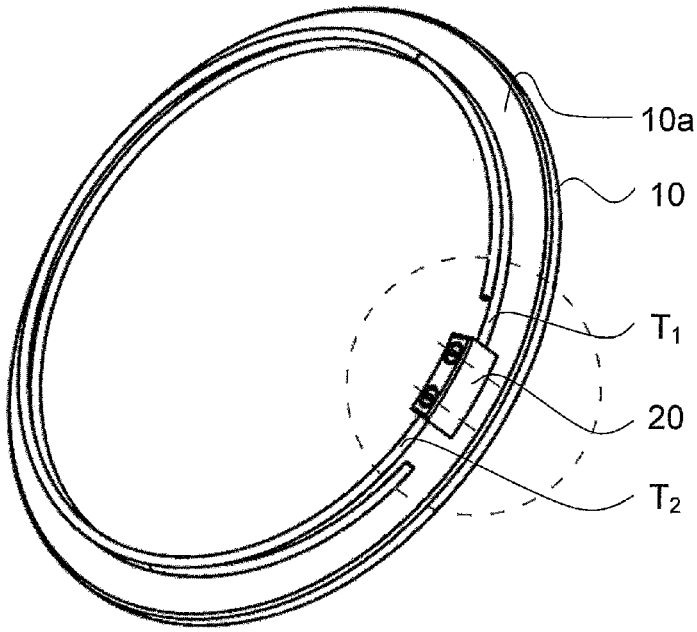
Figure 1A:
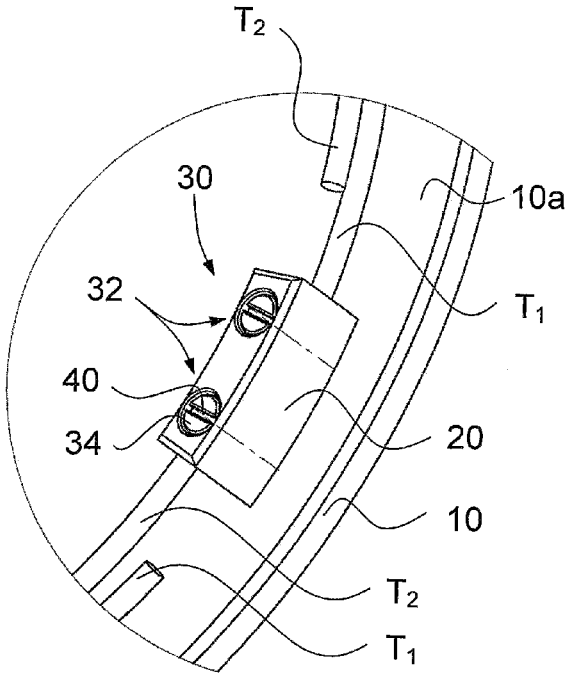
Figure 1B:
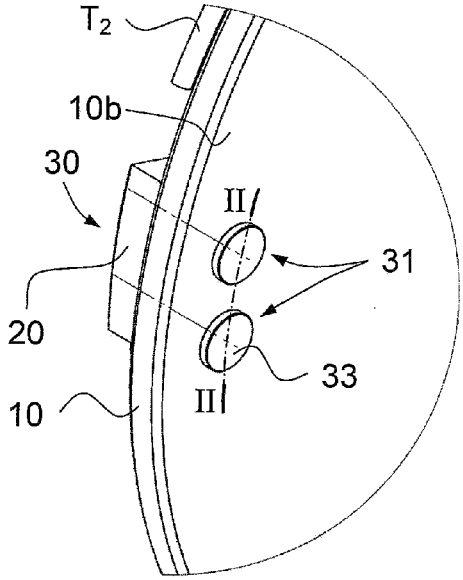
Figure 2:
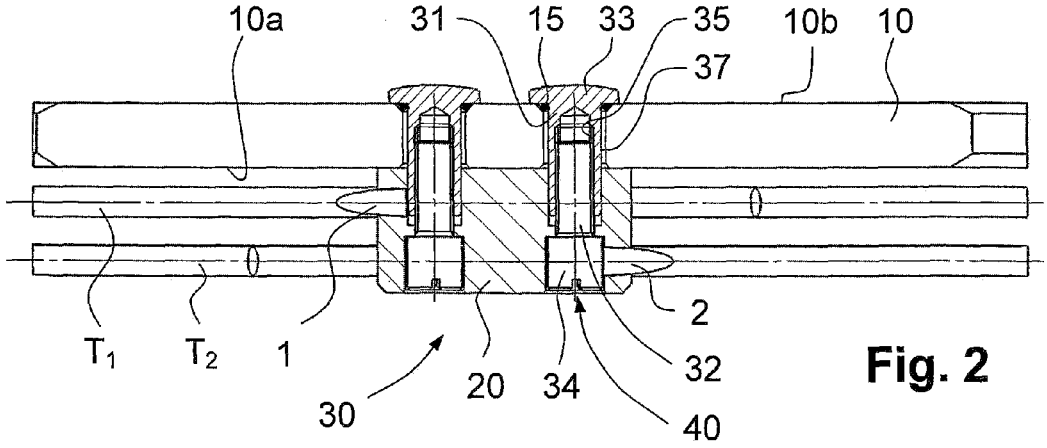
FIG. 2 is a simplified vertical cross section on II-II as marked in FIG. 1*b*.
Figure 4A:
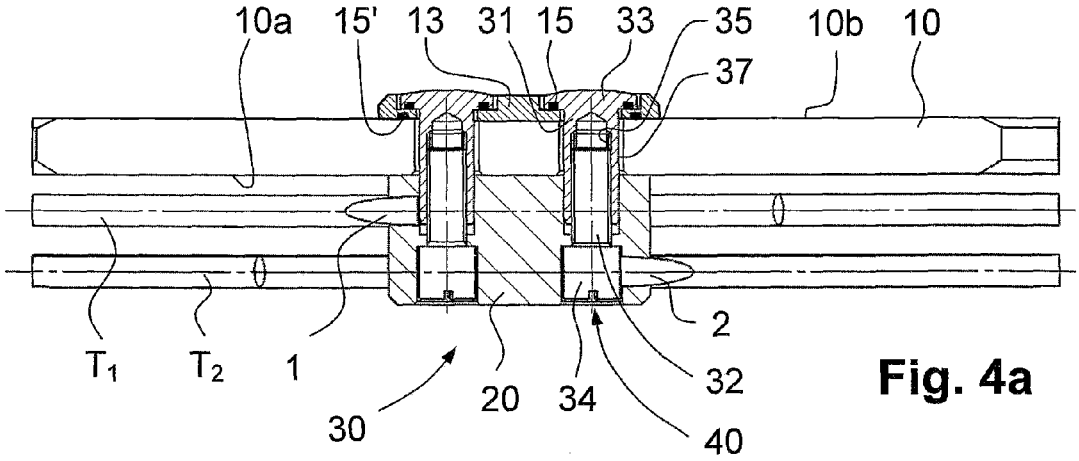
Figure 4B:
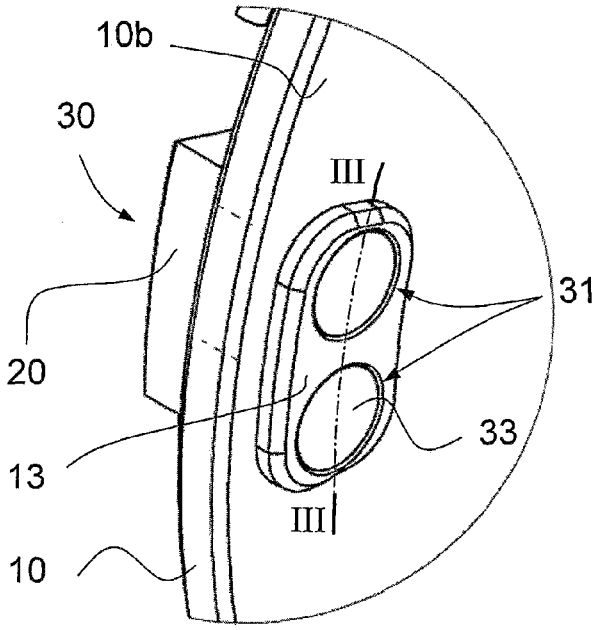

FIGS. 4*a* and 4*b* show a variant of the device illustrated in the corresponding FIGS. 2 and 1*b*.

It should be pointed out that the crystal used to close the case may either be that on the top, the dial side, or underneath, the back.

Referring to FIG. 1, this shows schematically the inner face 10*a* of a crystal 10 designed to close a watch case (not shown) for a timepiece fitted with a striking device. The latter is shown partially here by two gongs $T_1$, $T_2$ immobilized at least one end 1, 2 (more clearly visible in FIGS. 2, 3 and 3*a*) in a support termed the block 20. It will seen that the number of gongs is irrelevant to the subject of the invention. Usually from 1 to 3, it basically depends only on the type of striking watch, examples of which include repeating watches, grand strike watches and chimes.

FIG. 1*a* shows in more detail the portion of FIG. 1 shown ringed in dashes. FIG. 1*b* shows the same detail but viewed from the outer face 10*b* of the crystal. As is clear from these figures, the block 20 is held in contact with the inner face 10*a* of the crystal by a mounting means 30. This mounting means consists of a clamping-type mounting means that enables the block 20 to exert constant pressure on the crystal 10.

With reference to FIG. 2, this shows the device of the invention in a simplified vertical cross section on II-II as indicated in FIG. 1*b*. The clamping-type mounting means 30 comprises at least one pair of threaded members, mainly at least one first element or threaded member 31 designed to engage with a threaded portion 32 on the block 20. The first threaded member 31 is provided at one of its two ends with a head 33 designed to act as at least a bearing surface when this member is applied to the outer face 10*b* of the crystal 10. As can be seen clearly in FIG. 1*b*, this head 33 preferably has a smooth surface with no recess or holding means of any kind.

Returning to FIG. 2, it can be seen that the threading on this first member consists of a tapped thread, that is internal threading 35, formed in the tubular body of this member. More precisely, this tapped thread is machined in a blind hole in this open body in the opposite end to that topped by the head 33. The outer part of the body of this first threaded member 31 is a preferably smooth and cylindrical outer segment or surface 37.

As shown in FIG. 2, the threaded portion 32 corresponds more particularly to the threading of a second threaded member which is preferably completely embedded in the block 20. Again preferably, this second member consists of a screw whose head 34 sits in a counterbored hole in the free surface of the block 20.

With the preferred embodiment of the mounting device of the invention, the mounting device incorporates an adjustment means 40 that makes it possible advantageously to modify the clamping force generating the pressure between the block 20 and the crystal 10. As shown in FIGS. 1*a*, 2, 3, 3*a* and 4*a*, this adjustment means can be used to act on the couple consisting of the first threaded member 31 and the threaded portion 32 which, depending on the case, corresponds to the second threaded member. This adjustment means preferably consists of a recess offering a means of control to allow one or other of these threaded members to be operated. In accordance with FIG. 2, this adjustment means 40 is on the head 34 of the second threaded member and allows this member to be tightened or slackened within the tapped thread 35 of the first threaded member 31.

To ensure that the watch case remains sealed, one first seal 15 is also placed at the interface between the crystal 10 and the head 33 of the first threaded member 31. Of circular shape and preferably torroidal, this seal is designed to be housed in the outer surface 10*b* of the crystal, in the depression of a chamfer machined around the edge of the circular opening through which the first threaded member is to pass. The diameter of this circular opening is preferably greater than that of the first threaded member in order to provide a clearance useful for positioning the block on the crystal, more specifically for positioning the gongs relative to the hammer of the striking device which will strike them. Thus, this clearance defines the latitude of positioning of the block 20 relative to the crystal 10 against which it is intended to be clamped.

The gongs $T_1$ and $T_2$ are each held in the block 20 by insertion of one of their ends 1, 2, respectively, in a hole whose axis is parallel to that of the plane of the crystal 10. This hole is preferably also situated in the vertical central plane of the block 20, in accordance with the cross sectional view shown in FIG. 2.

FIG. 3 refers to a variant of the mounting means 30 illustrated in FIGS. 1*a*, 1*b* and 2. In this other embodiment, the adjustment means 40 can be seen to be provided on the head 33 of the first threaded member. In particular, the adjustment means 40 consists of a groove or slot comparable with or identical to that illustrated in FIG. 1*a*, allowing a tightening tool to be inserted in order to apply the appropriate clamping force. Of course, it would also be possible to use pins or holes instead of such a recess.

Although no clearance is shown in this figure between the first threaded member and the opening provided for its passage through the crystal, it will be understood that the pair of threaded members shown here in a variant could equally well perform its function if there were such a clearance.

The second threaded member illustrated in this FIG. 3 consists more precisely of a pin, a first part 36 of the length of which is threaded. By this means the first threaded member 31 can be screwed to it. The second part 38 of the pin is designed to prevent any rotation of the second threaded member within the opening 21 in the block 20 for accommodating the second threaded member. Although shown as a through hole, this opening 21 could be a blind hole open to the crystal side. This member can be prevented from turning by a key, for example. Alternatively, rotation could be prevented by screwing the second part 38 into a thread tapped in the opening 21, or by a bayonet system or clamping, with this second part being driven in.

In an identical or similar way, it would also be possible to prevent rotation of the first threaded member described in the preferred embodiment referring to FIG. 2.

FIG. 3*a* shows a variant of the device of FIG. 3 in which the first threaded member 31 has no internal thread but does have an external thread 35'. The latter is at the end of the outer surface 37 of this member. Hence this outer surface comprises firstly a smooth segment designed to be positioned within the thickness of the crystal 10, and secondly a threaded segment at the opposite end from the head 33. The threaded segment is for screwing into the threaded portion 32, which in this case consists of a thread tapped directly into the block 20, for example a blind hole 21'.

The mounting device of the present invention will also preferably incorporate a means for positioning the block 20 against the crystal 10, especially against the inner surface 10*a* of this crystal. In the embodiment shown in FIG. 3, this positioning means is provided by a bore 50 formed within the block 20, coaxial with the opening 21, 21' for insertion of the second threaded member. This bore is able to receive, without clearance, the free end of the outer surface 37 of the first threaded member. By engaging this outer surface in the bore 50, the block 20 can be positioned precisely against the crystal 10. The relative positions of the block and crystal can be defined by such a means provided there is no clearance between the first threaded member and the circular opening provided for its passage through the crystal.

As a variant, it would also be possible to achieve identical positioning by a system of engagement of a ball in a cavity, or a pin or dowel in an orifice.

Referring to FIGS. 4*a* and 4*b*, these illustrate yet another embodiment of the device shown in FIGS. 2 and 1*b*, respectively. FIG. 4*a* corresponds to a simplified vertical cross section on as marked in FIG. 4*b*. This figure shows the addition of a collar 13 positioned between the crystal 10 and the associated bearing surface of the first threaded member 31, in this case the head 33. The latter thus bears against the crystal via the collar 13, whose purpose is to extend the contact area on the outer face 10*b* of the crystal in order to reduce the pressure applied to the latter.

In such a configuration, a second seal 15' is provided at the interface between the crystal 10 and the collar 13, while the first seal 15 is in this case positioned at the interface between the collar 13 and the head 33. This second seal 15' is designed to sit in a groove formed in the inner surface of the collar 13, along a closed curve running around the opening or openings for the passage of the first threaded member or members 31.

As shown in FIGS. 4*a* and 4*b*, in which the clamping-type mounting means 30 comprises two pairs of threaded members 31, 32, the collar 13 acts as a bridge between the two heads 33 and thus gives them a common seat.

In the embodiments described in the present account, the clamping force has been obtained by tightening a threaded member. However, it should be pointed out that other mechanical means could also provide the same effect. As an example, this clamping force could be obtained by rotating an eccentric or turning a small hinged lever arm.

As illustrated in the accompanying figures, the mounting device 30 comprises two couples, each consisting of a first threaded member 31 and a threaded portion 32. However, the number of these couples could of course be different.

The invention claimed is:

1. Gong mounting device designed to bear against a crystal closing a striking-watch case, comprising a block for immobilizing at least one end of a gong inside the watch case, and a means for mounting this block on said crystal, wherein the crystal comprises at least one opening and said mounting means is a clamping-type mounting means cooperating with said at least one opening and enabling the block to exert pressure on the crystal.

2. Mounting device according to claim 1, wherein said clamping-type mounting means comprises a means for adjusting the clamping force applied between the block and the crystal.

3. Mounting device according to claim 2, wherein the applied clamping force is produced by tightening a threaded member, or by rotating an eccentric, or by turning a lever arm.

4. Mounting device according to claim 2, wherein the clamping-type mounting means comprises at least one first threaded member, which has a head facing the outer face of the crystal and which is designed to engage with a threaded portion housed in the block.

5. Mounting device according to claim 4, wherein a first seal is arranged at an interface between the crystal and the head of the first threaded member.

6. Mounting device according to claim 4, wherein the head bears against the crystal via a collar which increases the contact area on the outer face of the crystal in order to reduce the pressure exerted on the crystal.

7. Mounting device according to claim 6, wherein a second seal is arranged at an interface between the crystal and the collar and in that the first seal is positioned at an interface between the collar and the head.

8. Mounting device according to claim 6, wherein the head of the first threaded member has no recess.

9. Mounting device according to claim 4, wherein the head of the first threaded member has no recess.

10. Mounting device according to claim 1, wherein the applied clamping force is produced by tightening a threaded member, or by rotating an eccentric, or by turning a lever arm.

11. Mounting device according to claim 1, wherein the clamping-type mounting means comprises at least one first threaded member, which has a head facing the outer face of the crystal and which is designed to engage with a threaded portion housed in the block.

12. Mounting device according to claim 11, wherein a first seal is arranged at an interface between the crystal and the head of the first threaded member.

13. Mounting device according to claim 11, wherein the head bears against the crystal via a collar which increases the contact area on the outer face of the crystal in order to reduce the pressure exerted on the crystal.

14. Mounting device according to claim 13, wherein a second seal is arranged at an interface between the crystal and the collar and a first seal is positioned at an interface between the collar and the head.

15. Mounting device according to claim 11, wherein the head of the first threaded member has no recess.

16. Mounting device according to claim 11, wherein the first threaded member comprises a blind internal thread and a smooth outer surface.

17. Mounting device according to claim 11, wherein the first threaded member has an external thread.

18. Mounting device according to claim 1, which comprises a means for positioning the block on the crystal.

19. Mounting device according to claim 18, wherein said positioning means consists of the engagement of the outer surface of a first threaded member in a bore formed in the block.

20. Mounting device according to claim 1, wherein the opening is a circular opening.

21. Mounting device according to claim 1, wherein the opening is a circular opening and the mounting means comprises a first threaded member, wherein the circular opening has a diameter greater than a diameter of the first threaded member in order to provide a clearance useful for positioning the block on the crystal.

* * * * *